US010894621B2

(12) United States Patent
Tempany et al.

(10) Patent No.: US 10,894,621 B2
(45) Date of Patent: Jan. 19, 2021

(54) CARTON PACKING APPARATUS

(71) Applicants: Gary Tempany, Victoria (AU); Paul Tamasauskas, Victoria (AU)

(72) Inventors: Gary Tempany, Victoria (AU); Paul Tamasauskas, Victoria (AU)

(73) Assignee: PACWELL IP PTY LTD, Victoria (AU)

( * ) Notice: Subject to any disclaimer, the term of this patent is extended or adjusted under 35 U.S.C. 154(b) by 802 days.

(21) Appl. No.: 14/801,906

(22) Filed: Jul. 17, 2015

(65) Prior Publication Data

US 2016/0016683 A1 Jan. 21, 2016

(30) Foreign Application Priority Data

Jul. 17, 2014 (AU) ..... 2014902767

(51) Int. Cl.
*B65B 21/06* (2006.01)
*B65B 59/00* (2006.01)
(Continued)

(52) U.S. Cl.
CPC ..... *B65B 21/18* (2013.01); *B65B 21/06* (2013.01); *B65B 35/44* (2013.01); *B65B 43/52* (2013.01); *B65B 57/14* (2013.01); *B65B 59/003* (2019.05)

(58) Field of Classification Search
CPC ..... B65B 21/06; B65B 21/08; B65B 21/242; B65B 35/10; B65B 35/18; B65B 35/30
See application file for complete search history.

(56) References Cited

U.S. PATENT DOCUMENTS 2,968,898 A * 1/1961 Hickin ..... B65B 21/06 53/157
3,057,267 A * 10/1962 Johnson, Jr. ..... B65B 43/345 493/181

(Continued)

FOREIGN PATENT DOCUMENTS

DE 3339045 * 5/1985 ..... B65B 21/183

OTHER PUBLICATIONS

English Translation of DE 3339045 (Year: 1985).*

*Primary Examiner* — Gloria R Weeks
(74) *Attorney, Agent, or Firm* — AKC Patents, LLC; Aliki K. Collins

(57) ABSTRACT

A carton packing apparatus occupying a small footprint for efficient packing of articles includes a longitudinal frame housing and an article transfer means. The longitudinal frame housing has an article accumulation platform mounted within and in line with the longitudinal direction of the frame housing, wherein articles and cartons are fed transversely relative to the longitudinal direction of the frame housing to an article loading station and a carton receiving station respectively located adjacent opposite ends of the accumulation platform. The article transfer means is movably mounted within the frame housing, the transfer means being movable over an internal pathway substantially in line with the accumulation platform between an article pick up position and article dispensing condition. In an operating condition a predetermined number of articles at the article loading station are transferred to the accumulation platform, and wherein the transfer means transfers a predetermined number of articles on the accumulation platform to the carton receiving station over the internal pathway for filling the carton with the articles.

19 Claims, 10 Drawing Sheets
(9 of 10 Drawing Sheet(s) Filed in Color)

(51) Int. Cl.

| | |
|---|---|
| ***B65B 21/18*** | (2006.01) |
| ***B65B 35/44*** | (2006.01) |
| ***B65B 43/52*** | (2006.01) |
| ***B65B 57/14*** | (2006.01) |

(56) References Cited

U.S. PATENT DOCUMENTS 3,273,304 A * 9/1966 Winter, IV ..... B65B 5/065 294/87.1
3,452,508 A * 7/1969 Dzenis ..... B65B 21/06 53/247
3,914,921 A * 10/1975 Doran ..... B65B 35/40 198/418.5
4,237,673 A * 12/1980 Calvert ..... B65B 5/10 53/251
4,610,347 A * 9/1986 Inoko ..... B65G 47/086 198/418.5
4,633,643 A * 1/1987 Wood ..... B65B 39/006 53/248
4,691,496 A * 9/1987 Anderson ..... B65B 57/10 141/144
4,709,536 A * 12/1987 Hartness ..... B65B 21/06 53/247
4,932,190 A * 6/1990 Bergner ..... B65B 35/44 198/418.5
5,039,276 A * 8/1991 Leuvering ..... B65B 35/52 198/418.5
5,657,610 A * 8/1997 Dietrich ..... B65B 43/265 53/139.5
6,164,045 A * 12/2000 Focke ..... B65B 5/105 198/429
6,419,442 B1 * 7/2002 O'Brien ..... B65G 47/82 414/790.3
6,571,532 B1 * 6/2003 Wiernicki ..... B65B 21/183 414/225.01
6,688,839 B1 * 2/2004 Hirschek ..... B65B 21/06 198/347.1
7,401,453 B2 * 7/2008 Ford ..... B65B 21/242 53/251
7,506,490 B1 * 3/2009 Yohe ..... B65B 9/02 53/446
9,573,771 B2 * 2/2017 Papsdorf ..... B65B 35/44
9,663,305 B2 * 5/2017 Papsdorf ..... B65B 35/44
10,124,920 B2 * 11/2018 Kern ..... B65B 35/50
10,144,596 B2 * 12/2018 Yohe ..... B65G 47/082
2006/0090424 A1 * 5/2006 Tokarz ..... B65B 5/105 53/448
2006/0207220 A1 * 9/2006 Ford ..... B65B 21/242 53/398
2011/0154784 A1 * 6/2011 Poutot ..... B65B 5/024 53/443
2012/0031050 A1 * 2/2012 Werner ..... B65B 21/06 53/448
2016/0083129 A1 * 3/2016 Prahm ..... B65B 65/003 53/475

* cited by examiner

CARTON PACKING APPARATUS

CROSS REFERENCE TO RELATED CO-PENDING APPLICATIONS

This application claims the benefit of Australian provisional application Serial No. 2014902767 filed on Jul. 17, 2014 and entitled CARTON PACKING APPARATUS, which is commonly assigned and the contents of which are expressly incorporated herein by reference.

FIELD OF THE INVENTION

The present invention relates to a carton packing apparatus for efficient loading of articles in a production process line such as bottles and the like containers into cartons for storage and/or transport. In particular the present invention relates to an improved carton packing apparatus for substantially continuous loading of articles such as bottles or like containers in bulk quantities into cartons for packaging, supply and transport of the cartons.

BACKGROUND OF THE INVENTION

It is usual practice in a production line of manufactured articles, for the articles to be supplied substantially continuously to a packing assembly line. It is also conventional for a packing assembly line to comprise a number of people whose job it is to transfer a plurality of articles supplied, into a carton or like container for packaging the articles.

While the task of transferring a plurality of articles from a substantially continuous supply of articles into a carton is tedious in the sense of being repetitive and labor intensive, practical problems often arise with effective transfer and arrangement of the articles in a carton. In particular, in a production packing line, articles firstly need to be organized on a supply line, efficiently removed from the supply line, transferred to a carton, and placed in or arranged in a carton in a consistent fashion.

Issues such as concentration lapses due to the tedious nature of a packing assembly line, or even general handling of articles, can lead to loss of articles during transfer which adds time and cost to the overall packing process. This type of issue is often exacerbated by the type of article to be packed. For example, articles such as plastic bottles, round bottles, irregular bottles, and different kinds of glass bottle, columned and oval-shaped bottle, square cans and paper cans can be problematic making efficient handling difficult. In addition, in such an assembly line there can be inconsistent packing resulting in unwanted variability in number of articles between cartons.

To address at least some of the practical issues associated with a packing assembly line, attempts have been made to provide an automatic carton packing machine. One type of carton package machine for packing bottles, uses an array of clamps located on a movable head. The head is movable between a bottle receiving station where an array of bottles is supplied for pickup and a carton fill station whereby the carton fill station is located beside the bottle station in a substantially parallel plane.

In operation, the head is positioned such that the array of clamps are sufficiently close to the bottle receiving station to engage the/a bottle supplied thereon. Each clamp of the array of clamps includes a rubber end portion to minimize damage to the/a bottle in an engaged condition. Once bottles are engaged by a clamp, the head is then moved to a second position adjacent the carton fill station and lowered where bottles are released into a prepared carton.

While this machine allows a plurality of bottles to be transferred from a supply station to a carton, there are several drawbacks. One such drawback is that prior to entering the bottle receiving station, bottles need to be manually arranged on an in-feed belt in a configuration corresponding to the array of clamps so that when the bottles are supplied to the bottle receiving station, the bottles are presented in a format for engagement by the clamps. If bottles are not presented properly for engagement by the clamps, then bottles may be broken during engagement and/or misalignment manually corrected.

A further drawback of the prior art machine is that it occupies a substantial footprint within which to operate not the least because a pattern of articles needs to be pre-formed, and a large array of clamping structures is required to engage each article in the pattern formed, and then transfer the load to a carton remote from the supply station.

The prior art goes some way to addressing issues associated with conventional production/assembly line packaging, however there remains a need for a carton packer apparatus which can substantially continuously load articles such as bottles into a carton in a practical and effective way.

It is therefore an object of the present invention to address one or more of the foregoing problems. It is a further object to provide the public with a useful alternative.

SUMMARY OF THE INVENTION

The present invention is directed to a carton packing apparatus occupying a small footprint for efficient packing of articles including:

- a longitudinal frame housing having an article accumulation platform mounted within and in line with the longitudinal direction of the frame housing, wherein articles and cartons are fed transversely relative to the longitudinal direction of the frame housing to an article loading station and a carton receiving station respectively located adjacent opposite ends of the accumulation platform;
- an article transfer means movably mounted within the frame housing, the transfer means being movable over an internal pathway substantially in line with the accumulation platform between an article pick up position and article dispensing condition; and
- wherein in an operating condition a predetermined number of articles at the article loading station are transferred to the accumulation platform, and wherein the transfer means transfers a predetermined number of articles on the accumulation platform to the carton receiving station over the internal pathway for filling the carton with the articles.

The carton packing apparatus of the present invention represents an advance over prior art packing machines because it substantially minimizes the need for a person or persons to prearrange articles on an in-feed conveyor, and reduces person handling issues which arise with the consequence of a separate handling step.

The carton packing apparatus can include an article in-feed conveyor mounted to the frame housing extending transverse to the accumulation platform, wherein the article loading station forms a part of the in-feed conveyor adjacent a first end of the accumulation platform, wherein the article loading station is adapted to receive a predetermined number of articles thereon for transfer to the accumulation platform.

The carton packing apparatus can include a carton in-feed conveyor mounted within and extending across the frame housing beneath the accumulation platform, the carton in-feed conveyor defining a carton travel pathway transverse to the longitudinal direction of the frame housing and located forward of the article in-feed conveyor, wherein the carton receiving station forms part of the carton in-feed conveyor and is located adjacent a second end of the accumulation platform for receiving a predetermined supply of articles.

The carton receiving station can include an elevator for lifting a carton thereon so as to adjust the position of the carton on the receiving station for loading articles therein. This allows for adjusting the position of the carton receiving station relative to the accumulation platform, and allows use of a range of different carton sizes.

The carton receiving station can further include a sub-assembly and an array of hand members movable on or over the sub-assembly, wherein the hand members are operably movable over defined pathways laterally and longitudinally according to dimensions of a carton at the receiving station to secure an internal liner for the carton. This represents an advance over the prior art because it functions to substantially minimize displacement of plastic liners for example, which can be easily moved and upset arrangement of articles.

The carton packing apparatus can include a drive assembly mounted within the frame housing, wherein the article transfer means is movable by the drive assembly over an internal pathway substantially in line within the frame housing above the accumulation platform between an article pick up and dispensing condition.

The drive assembly can include a track system mounted within the frame housing forming the internal pathway, and a chain drive assembly interconnected to the transfer means, wherein in a transfer condition the chain drive engages with the transfer means to move the transfer means over the track system between a pick-up position and a delivery/dispensing position. The drive assembly can also be operably connected to an actuator which actuates the drive assembly when the sensor detects a predetermined number of articles on the accumulating platform.

The carton packing apparatus can also include an article accumulation sensor within the frame housing operably connected to the drive assembly, wherein when a predetermined number of articles is located on the accumulation platform, the sensor actuates the drive assembly for movement of the transfer means over the internal pathway between an article pick-up position and article delivery position. When a predetermined number of articles is detected on the accumulation platform by the sensor, the sensor actuates the drive assembly.

The sensor is configured to detect a predetermined number of articles on the accumulation platform so that when the predetermined number of articles is detected, the drive assembly actuates the transfer means to move between a pick up position relative to the accumulation platform and a delivery position relative to the carton receiving station over the internal pathway.

In one embodiment the drive assembly can include a vibrating operating mode operable in a dispensing condition to apply a vibrating action to the transfer means at the point of dispensing the articles into a carton, wherein an array of articles is subject to a vibration action to assist arranging the articles in the carton.

In a further embodiment, the transfer means can include a sub-assembly mounted within the frame housing above the accumulation platform, the sub-assembly comprising a vacuum hood and chain drive system powered by an electric motor interconnected to the vacuum hood, such that the vacuum hood is movable by the chain drive over the article transfer pathway coaxial with the longitudinal direction of the frame housing.

The vacuum hood can include a vacuum chamber effective for receiving a predetermined number of articles therein under vacuum for transfer. The vacuum hood can include a vibration mechanism such that a load of articles such as bottles or the like can be stabilized once dispensed in the carton.

The sub-assembly can further include a complementary track formed in the housing and wheels mounted to the vacuum hood, wherein the wheels engage the track in an operating condition during transfer of a predetermined number of articles between the article accumulation platform and the carton loading station.

The carton packer can include a pushing means located adjacent the article loading station, wherein when a predetermined number of articles is presented at the loading station, the pushing means operates reciprocally laterally and longitudinally relative to the loading station to push the predetermined number of articles onto an adjacent front surface portion of the accumulation platform, and wherein lateral movement allows repositioning for the next predetermined row of articles. In this way the pushing means can provide alternating offset rows of articles to the accumulation platform, and can save time by not having to reverse the infeed conveyor to reposition an alternating row.

In a further embodiment the carton packing apparatus can include a movable wall partition intermediate the pusher means and the accumulating platform, wherein in an article receiving condition the pusher means and the movable wall partition form opposite facing walls to substantially stabilize articles received at the article loading station, and wherein when a predetermined number of articles is received at the loading station, the movable partition is displaced to allow transfer of the articles by the pusher means onto a front portion of the accumulation platform.

The carton packing apparatus can further include a gate located adjacent the pushing means, the gate being reciprocally operable between a front portion of the accumulation platform and the article loading station, wherein the gate forms an angled wall with the pushing means to assist positioning and stabilizing of articles at the loading station, and wherein when a predetermined number of articles is located at the article loading station, the gate and pushing means sweep the predetermined number of articles onto a front portion of the accumulation platform in a cradled condition.

In a related aspect of the present invention there is described a carton packing apparatus for efficient packing of articles such as plastic or glass bottles and the like into a carton, the apparatus including:

i. a longitudinal frame housing;

ii. an article accumulation platform mounted within the frame housing for receiving a predetermined number of articles thereon;

iii. an article in-feed conveyor mounted to the frame housing extending transverse to the accumulation platform, the in-feed conveyor including an article loading station adjacent a first end of the accumulation platform, wherein the article loading station is adapted to receive a predetermined number of articles thereon for transfer to the accumulation platform;

iv. a carton in-feed conveyor mounted within and extending across the frame housing beneath the accumulation platform, the carton in-feed conveyor defining a carton travel pathway transverse to the longitudinal direction of the frame housing and located forward of the article in-feed conveyor, wherein the carton in-feed conveyor comprises a carton receiving station adjacent a second end of the accumulation platform opposite the first end, for receiving a predetermined supply of articles;

v. an article transfer device movably mounted within the frame housing for transporting articles from the accumulation platform to the carton receiving station, the transfer means being movable over an article transfer pathway within the housing between an article pick-up position and a carton loading position, wherein the pathway is substantially coaxial with the longitudinal direction of the frame housing;

wherein when a predetermined number of articles is supplied to the accumulation platform, the transfer device is operable to transfer the predetermined number of articles from a pick-up position on the accumulation platform to the carton receiving station for dispensing articles into the carton.

A further advantage of the present invention is that the configuration provides for transfer of bulk articles in a plane within the frame housing collinear with the longitudinal direction of the frame housing. Consequently, the carton apparatus of the present invention occupies a relatively small footprint. The small footprint is a substantial advantage gained by collinear relationship and pathway over which the transfer means traverses between the article loading station, the accumulation platform, and the carton receiving station.

The article transfer device can include:

i. a gantry structure above the accumulation platform, ii. an article pick up device movably mounted on the gantry, iii. a track within the frame housing forming a pathway between the article pick up position and article delivery/dispensing position; and iv. a drive assembly mounted within the frame housing interconnected to the article pick up device for driving movement of the article pick up device over the track, and wherein when a predetermined number of articles is accumulated on the accumulation platform, the transfer device operates to move the transfer means over the pathway between the article pick-up position and dispensing position, and returns to the article pick-up position for substantially continuous packing in a reduced footprint.

The carton packer can include a pushing means reciprocally located adjacent the article receiving station for urging a predetermined number of articles at the receiving station onto a front surface portion of the accumulation platform in a direction transverse to the in-feed conveyor. Once the pushing means has pushed a predetermined load of articles at the receiving station onto a front surface portion of the accumulation platform, the pushing means returns to a non-pushing condition clearing the article loading station for receipt of a subsequent load of articles from the in-feed conveyor. With each subsequent and predetermined supply of articles at the article loading station, the pushing means urges the subsequent supply of articles onto the front portion of the accumulation platform thereby displacing the previous supply along the accumulation platform until a predetermined number of articles is detected on the platform.

The pushing means can be adjusted laterally relative to the article receiving station to urge alternating rows of predetermined articles supplied at the article receiving station onto a front surface portion of the accumulation platform in alternating rows, wherein rows of articles are automatically arranged on the accumulation platform in an offset formation to allow for offset packing formation of the articles in automatic.

The pushing means can further include a shaped article receiving portion for receiving articles of a range of shapes and configurations. The article receiving portions of the pushing means can be complimentary to the shape of the article so as to accommodate different shaped articles stably for pushing onto the accumulation platform.

The carton packer can further include an article in-feed sensor located adjacent the article in-feed conveyor upstream of the article receiving station for determining article in-feed integrity, and a gate downstream from the article loading station, wherein the article in-feed sensor is operatively linked to the gate so that if an article is sensed as not being properly configured for transfer onto the accumulation platform, the gate will open for egress of articles until the sensor detects passage of a predetermined number of properly aligned articles.

The article in-feed sensor can be configured for assessing article dimensions and time between adjacent articles on the in-feed conveyor moving past the sensor. If for example, an article such as a bottle has inadvertently fallen on the in-feed conveyor, the sensor determines that the time taken between passage of one sensed bottle and its nearest neighbor is greater than would be otherwise expected for predetermined input bottle dimensions. This determination causes the sensor to actuate opening of the gate sufficient to allow the fallen bottle to exit the article receiving station.

The article loading station can include a gate operably located between a front surface portion of the accumulation platform and the article receiving station, wherein the gate forms a wall portion of the receiving station to assist stabilize articles in the receiving station and wherein when a predetermined number of articles is received at the article receiving station, the station gate is lowered to allow pushing of the predetermined number of articles onto a front surface of the accumulation platform.

The accumulation platform can include a platform sensor for determining a predetermined number of articles on the accumulation platform. Once a predetermined number of articles on the platform is detected, the platform sensor operably actuates the transfer means.

The accumulation platform can include an adjustable framework defining the area of the platform. The framework can include platform adjusters which allow adjustable width and length of the platform to accommodate a range of packing volumes. The platform space adjusters can include interengageable tongue and groove elements on the framework that allow slidable adjustment of width and length.

In a related aspect of the present invention there is disclosed a process for packing a carton with articles such as bottles or the like including:

providing a carton packing apparatus comprising:

a longitudinal frame housing;

an accumulation platform mounted within the housing for receiving a plurality of articles thereon;

an article in-feed conveyor defining an article pathway transverse to the accumulation platform, the in-feed conveyor including an article receiving station adjacent a front end portion of the accumulation platform, the article in-feed conveyor adapted for feeding articles to the article receiving station;

a carton in-feed conveyor defining a carton pathway parallel to and offset vertically from the article in-feed pathway, the carton in-feed conveyor including a carton receiving station located adjacent the accumulation platform distal the article receiving station;

a lifting station at the carton receiving station for lifting the carton to a carton loading position;

a transfer assembly within the frame housing, the transfer assembly including a transfer means movably mounted within the housing over a pathway coaxial with the longitudinal direction of the frame housing between the accumulation platform and carton receiving station;

wherein in an operating condition, a predetermined number of articles at the article receiving station is transferred from the article receiving station to a front surface of the accumulation platform forming a row of articles thereon, and wherein subsequent rows are formed by displacing a previous row when a predetermined number of articles is accumulated on the accumulation platform, the transfer means operably picks up and transfers the articles to a carton located at the carton loading station.

In the present invention an article in-feed conveyor feeds articles such as bottles and the like containers to a bottle receiving station. When a predetermined number of bottles is provided at the bottle receiving station, a pushing means sweeps the bottles onto a platform adjacent the station. This process is repeated with alternating offset rows of bottles by adjusting the lateral starting position of the pushing means. At substantially the same time, a carton for loading the bottles into, is conveyed by a carton infeed conveyor to a carton receiving station, wherein the carton receiving station and the bottle receiving station are spaced apart and define a substantially linear pathway therebetween. A transfer means, movably located within a frame assembly and drivable by a drive assembly, moves the predetermined number of bottles on the platform from the platform to the carton receiving station where the bottles are released into the carton at the carton receiving station.

In a further related embodiment, the present invention can include a plurality of carton packing apparatuses in series. In this embodiment, the article infeed conveyor and carton infeed conveyor can interlink a series of longitudinal frame housings in parallel so that multiple stations are being fed substantially continuously.

DESCRIPTION OF THE DRAWINGS

The patent or application file contains at least one drawing executed in color. Copies of this patent or patent application publication with color drawing(s) will be provided by the Office upon request and payment of the necessary fee. An embodiment of the present invention will now be described by way of example only with reference to the accompanying drawings in which.

DESCRIPTION OF THE PREFERRED EMBODIMENT WITH REFERENCE TO THE DRAWINGS

Figure 1:
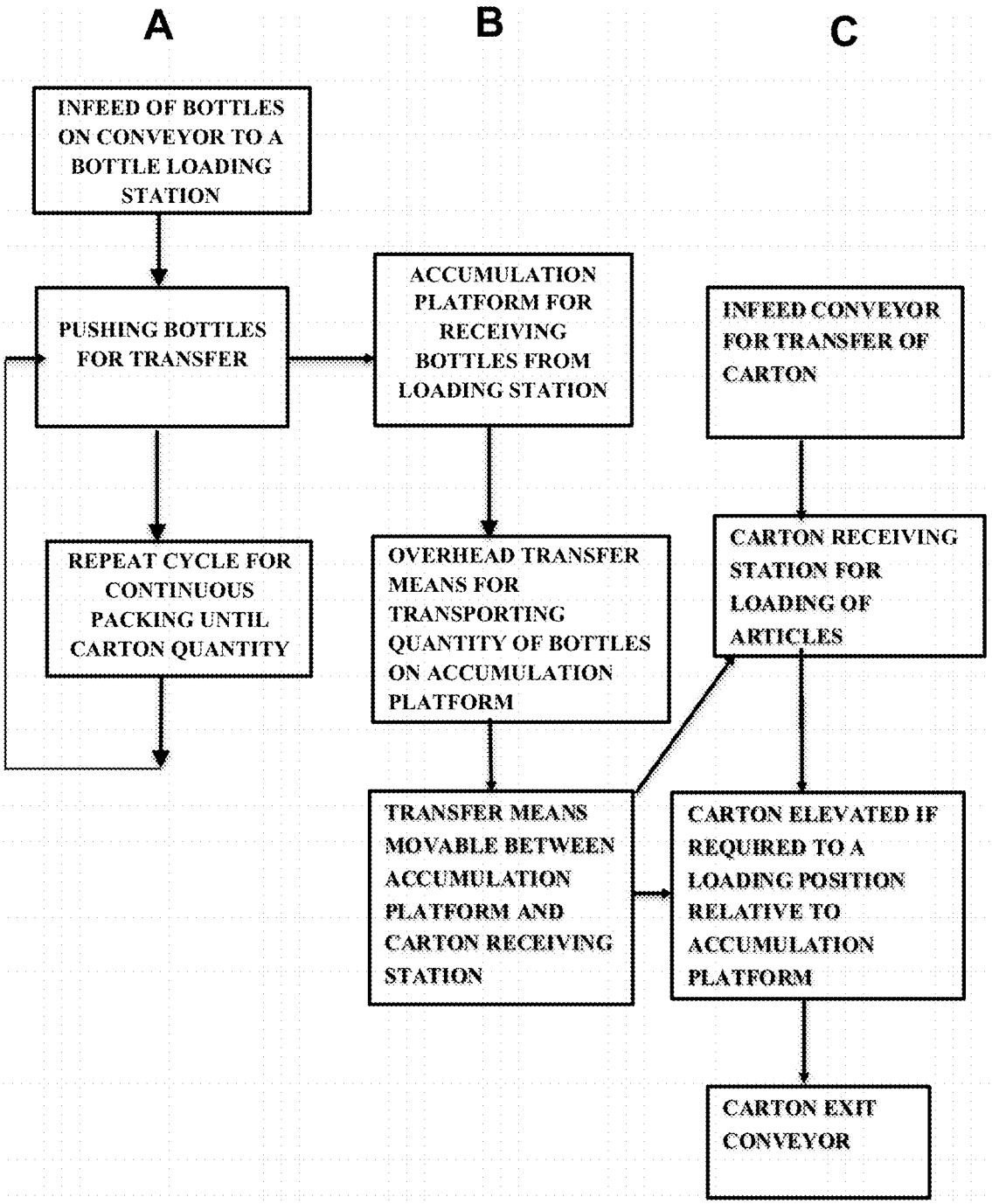
FIG. 1: is a schematic flow diagram of the automation of a carton packing apparatus in accordance with an embodiment of the invention.

Referring to the figures, there is shown a substantially continuous carton packing process and apparatus for efficient packing of cartons, which occupies a small footprint. As shown in FIG. 1, the automation process of the carton packer apparatus is for practical purposes divided into at least three functional interworking stages A, B and C.

In stage A, articles, indicated as plastic cylindrical bottles, are conveyed in single file by a bottle in-feed conveyor to an in-feed bottle receiving station. The in-feed receiving station includes a floor formed by a portion of the in-feed conveyor whereby when a predetermined number of bottles is received at the in-feed receiving station, a sensor located adjacent the in-feed receiving station sends a signal to a central operating system to actuate transfer of the predetermined row of bottles onto a front portion of an accumulation platform in stage B.

The in-feed receiving station further includes a pusher member located behind the row of bottles at the in-feed receiving station. When the sensor detects a predetermined number of bottles at the in-feed receiving station, the operating system actuates reciprocal movement of the pusher between a pushing and non-pushing condition to transfer the bottles from the in-feed receiving station onto a front portion of the accumulation platform.

In the above sensed condition, a first row of bottles is urged by the pusher onto a front surface of an accumulation platform (refer stage B) thereby forming a row of bottles on the accumulation platform. When a first row of bottles is received on the accumulation platform, the pusher returns to a non-pushing condition.

Once a first row of bottles is transferred to a front surface portion of the accumulation platform, a second predetermined row of bottles is received at the in-feed receiving station by the in-feed conveyor, whereby the second in-feed of bottles is again pushed by the pusher onto the front surface of the accumulation platform and in so doing displaces the previous row of bottles further along the accumulation platform in the longitudinal direction of the frame housing.

In the automation process represented at stage B, multiple rows of bottles are accumulated on the accumulation platform, and when a predetermined number of bottles is transferred to the accumulation platform, a transfer means is operable to pick up and deliver the predetermined number of bottles on the accumulation platform to a carton receiving station downstream therefrom.

Figure 12:
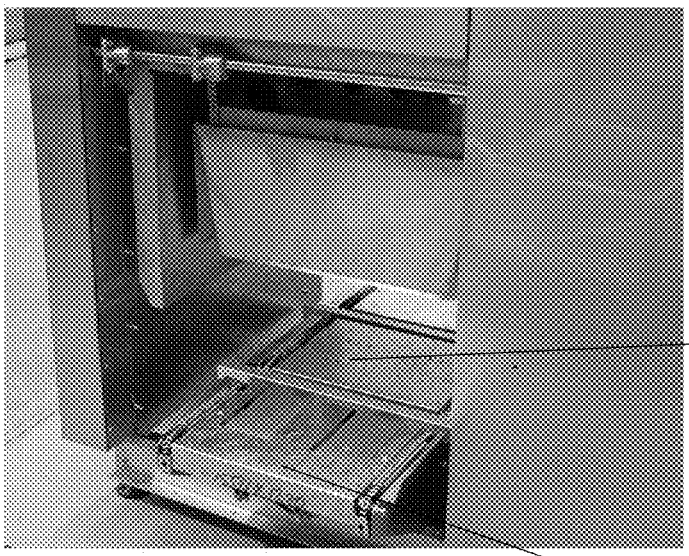
FIG. 12: shows a photograph of the carton packer of FIG. 3 from opposite side.

At the same time in stage C, cartons are being transferred by a carton in-feed conveyor in a direction transverse to the longitudinal direction of the frame housing, to a carton receiving station located relative to one end of the accumulation platform opposite the bottle in-feed receiving station. In one embodiment, the carton in-feed conveyor includes an elevator platform at the carton receiving station, which raises the carton to a carton loading position. Once bottles are dispensed into a carton from the transfer device, a filled carton exits the in-feed conveyor via an exit pathway 227 downstream from the carton receiving station, shown in FIG. 12.

Figure 2:
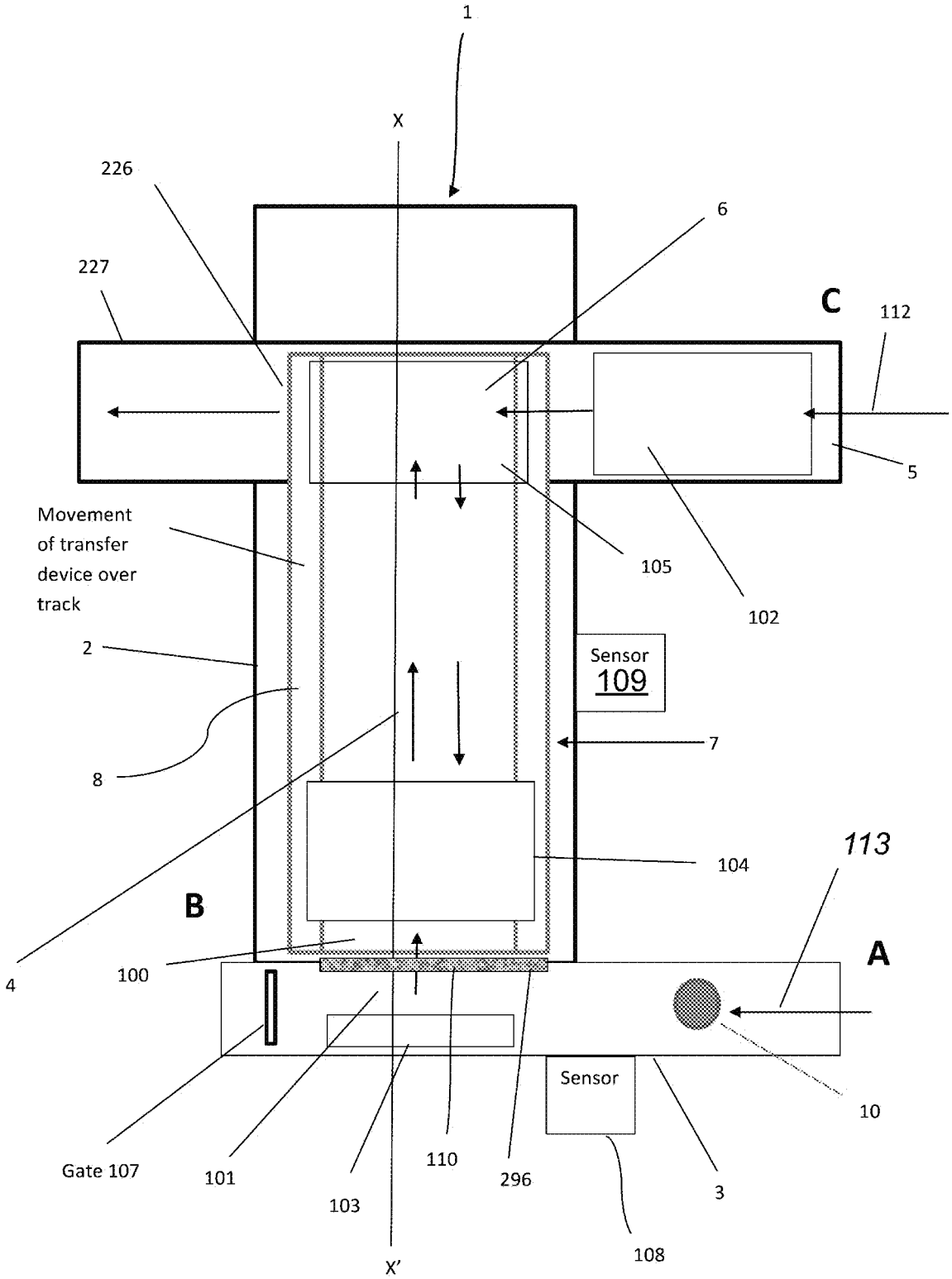
FIG. 2: is a diagrammatic overhead plan view of a carton packing apparatus in accordance with one embodiment of the present invention.

Referring to FIG. 2, the carton packing apparatus 1 includes a frame housing 2 being longitudinal in the direction of axis X-X'; a bottle in-feed conveyor 3 transverse to the longitudinal direction of the frame housing 2 for conveying bottles 10 in a single file to a bottle receiving station 101; a carton in-feed conveyor 5 mounted to the frame housing spaced from and extending parallel to the bottle in-feed conveyor for conveying a carton 102 to a carton receiving station 6; an accumulation platform 4 mounted within the housing oriented in the longitudinal direction of the frame housing, the accumulation platform extending substantially between the bottle receiving and carton receiving stations; a transfer means 7 movably mounted in the frame housing above the accumulation platform; and a pusher means 103 for pushing a predetermined sensed number of bottles at the bottle receiving station 101 onto a front portion 100 of the accumulation platform 4.

In an operating condition, when a predetermined number of bottles is located on the accumulation platform, the transfer means moves between a pick up position 104 for picking up the bottles on the platform, to a delivery position 105 close to the carton receiving station 6 for dispensing the bottles into the carton.

Figure 3:
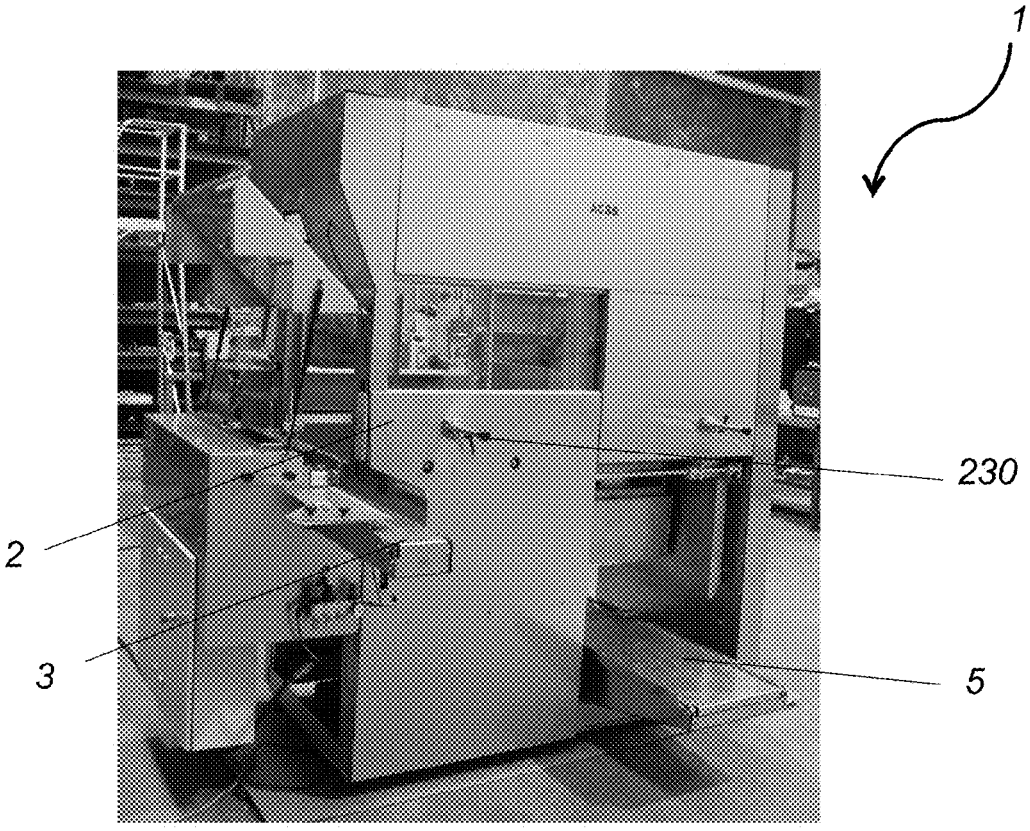
FIG. 3: shows a photograph of a carton packing apparatus in partial side elevation in accordance with one embodiment of the present invention.
Figure 4:
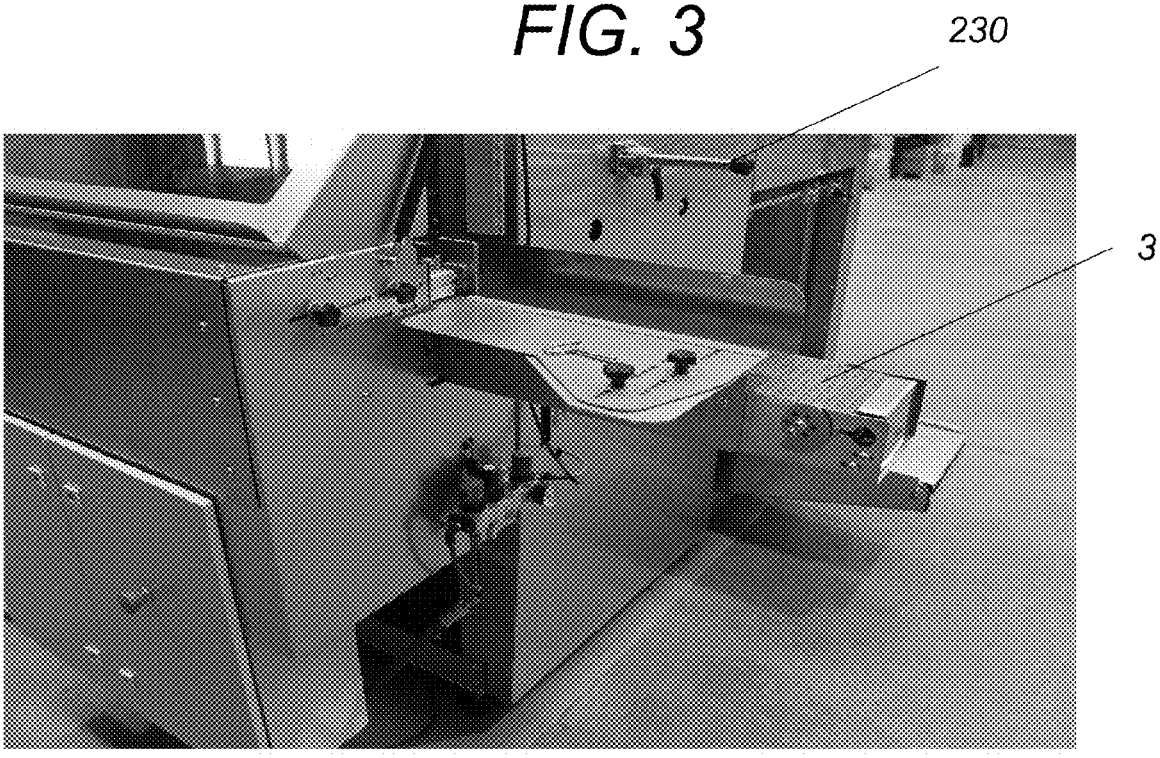
FIG. 4: shows a close-up photograph of a container in-feed conveyor element of the carton packing apparatus in FIG. 3.
Figure 3A:
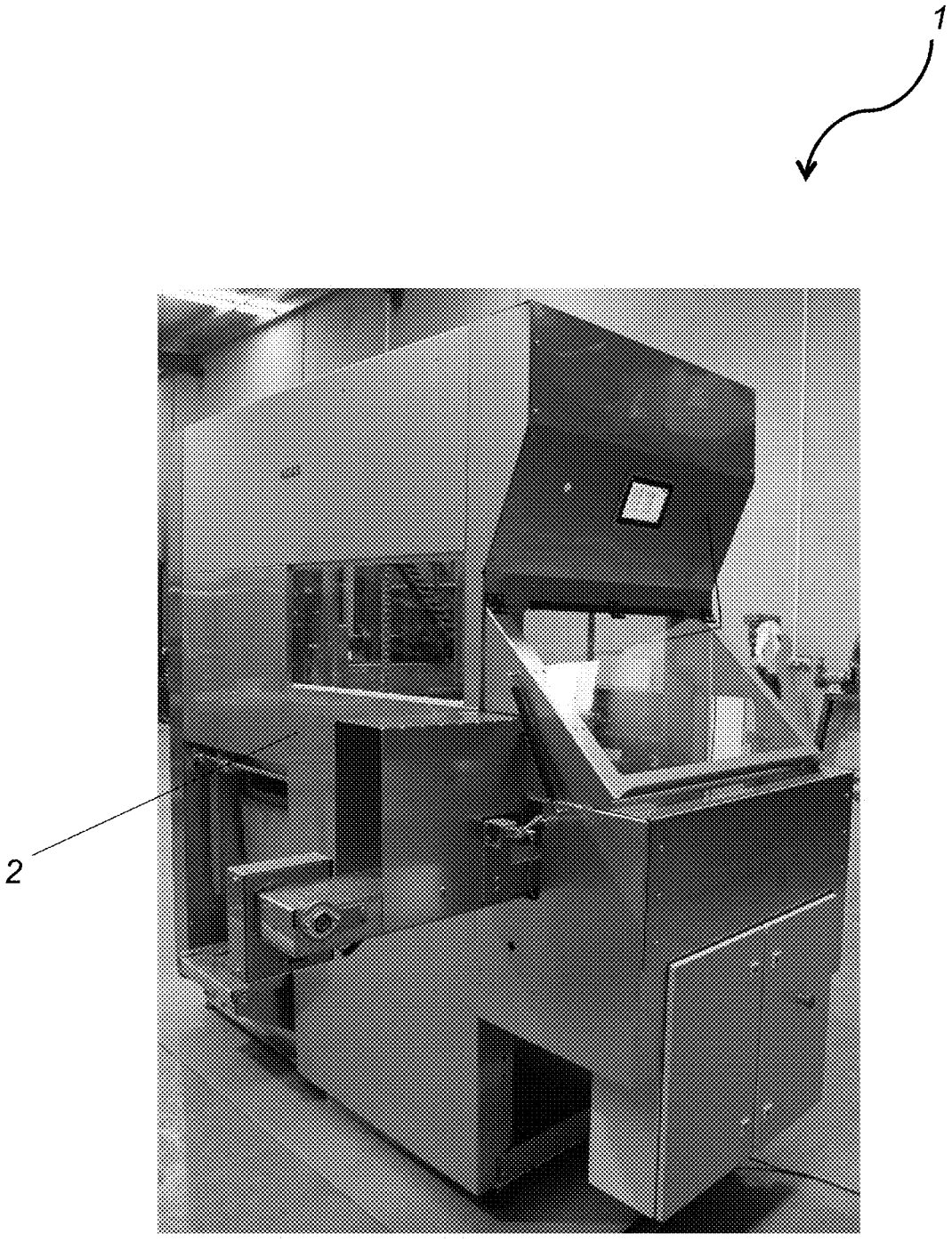
FIG. 3A: shows a photograph of the carton packing apparatus of FIG. 3 in partial side elevation opposite to the view in FIG. 3.
Figure 7:
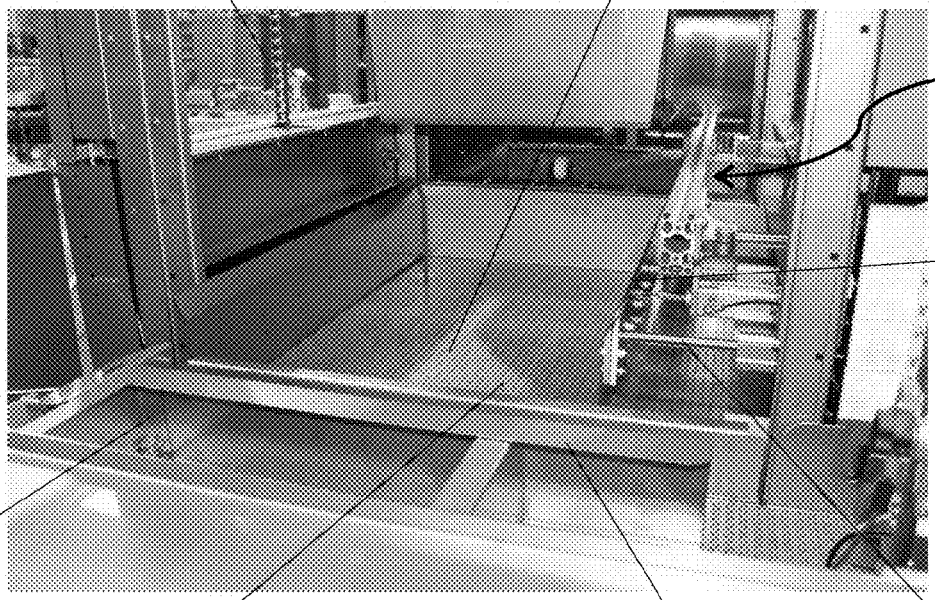
FIG. 7: shows a photograph of an article loading station and accumulation platform of the carton packing apparatus of FIG. 3.
Figure 8:
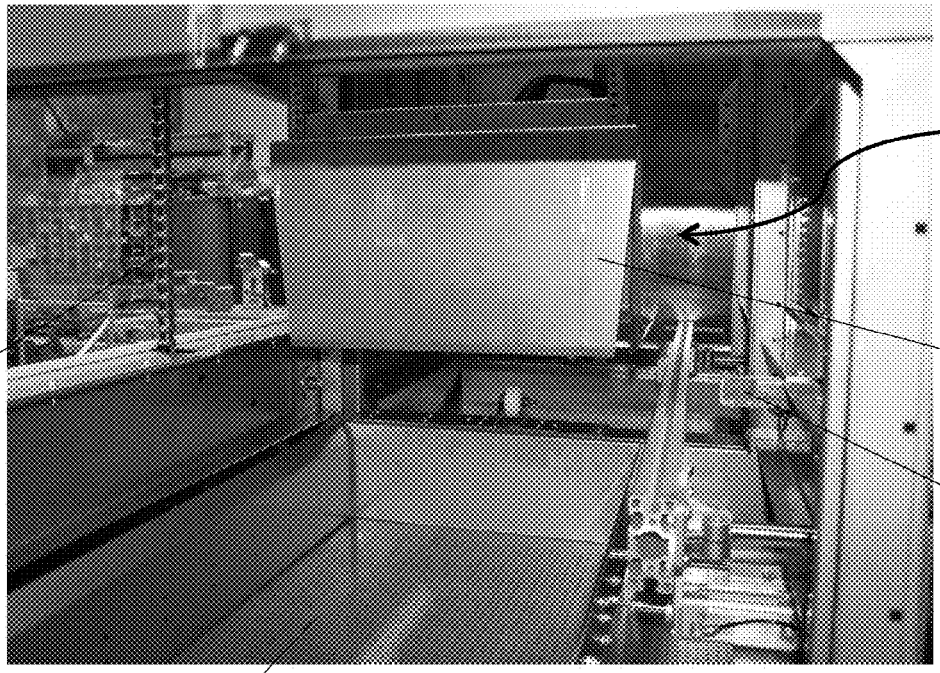
FIG. 8: shows a photograph of a frame hosing, accumulation platform and transfer means of the carton packing apparatus in accordance with FIG. 3.
Figure 9:
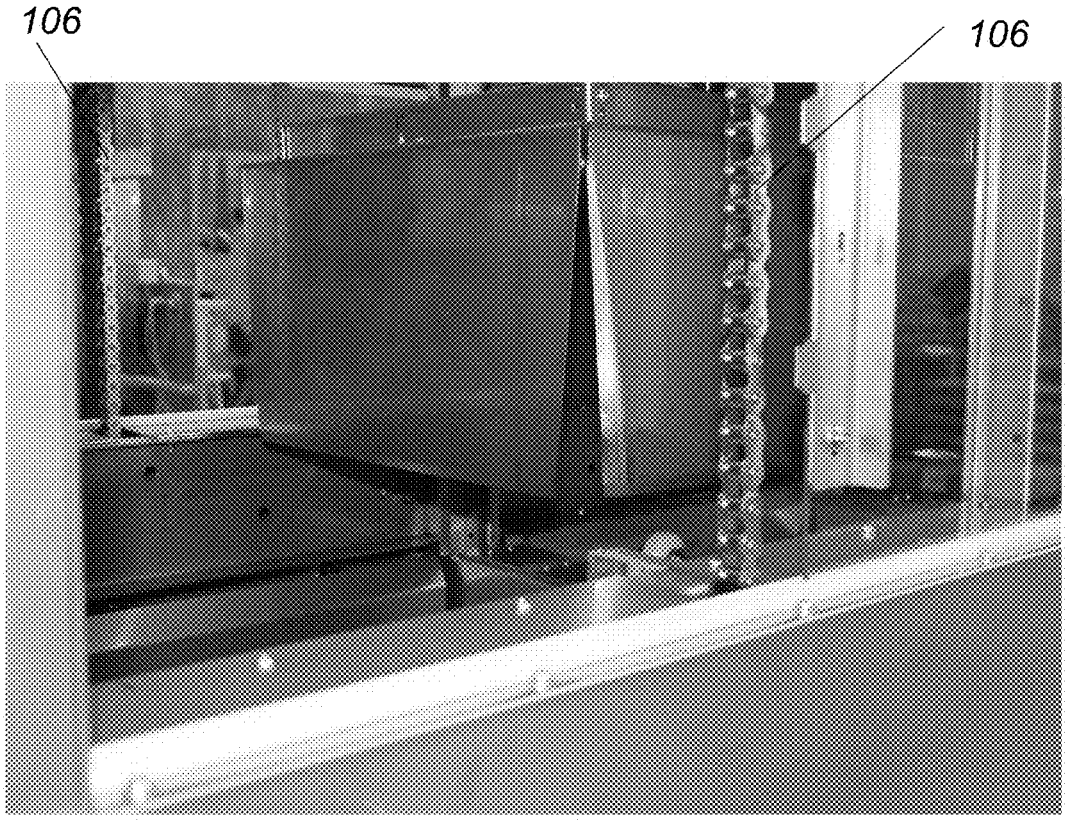
FIG. 9: shows a photograph of the transfer means in side elevation in accordance with FIG. 8.
Figure 10:
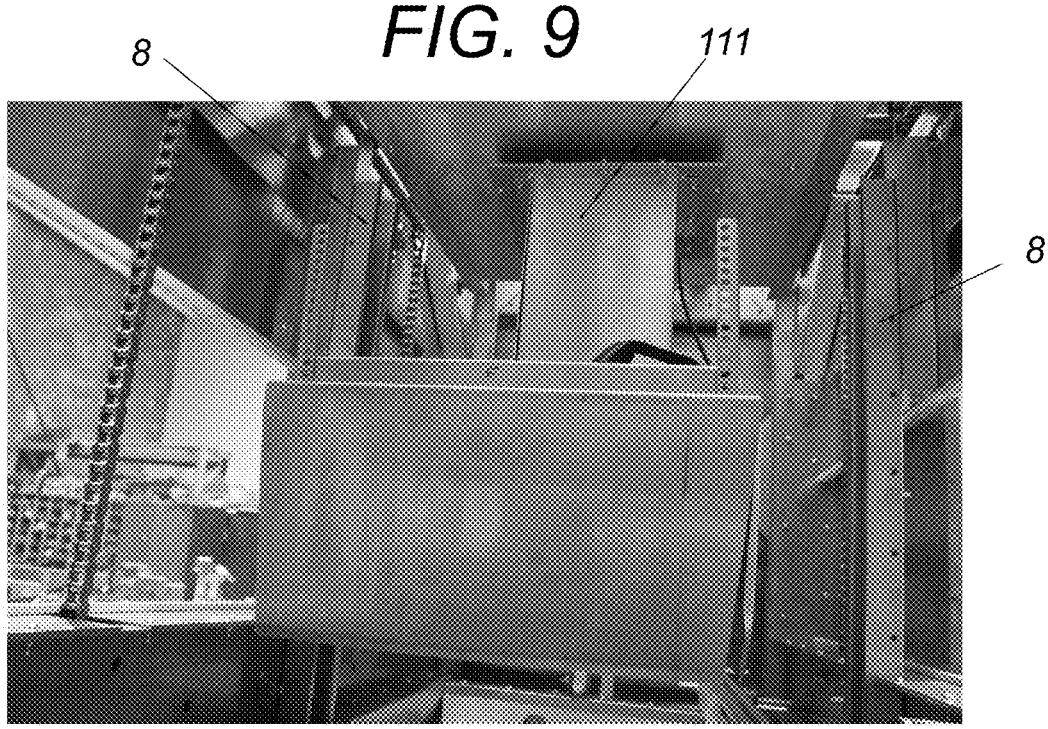
FIG. 10: shows a photograph of the transfer means in FIG. 9 from a front end view.
Figure 11:
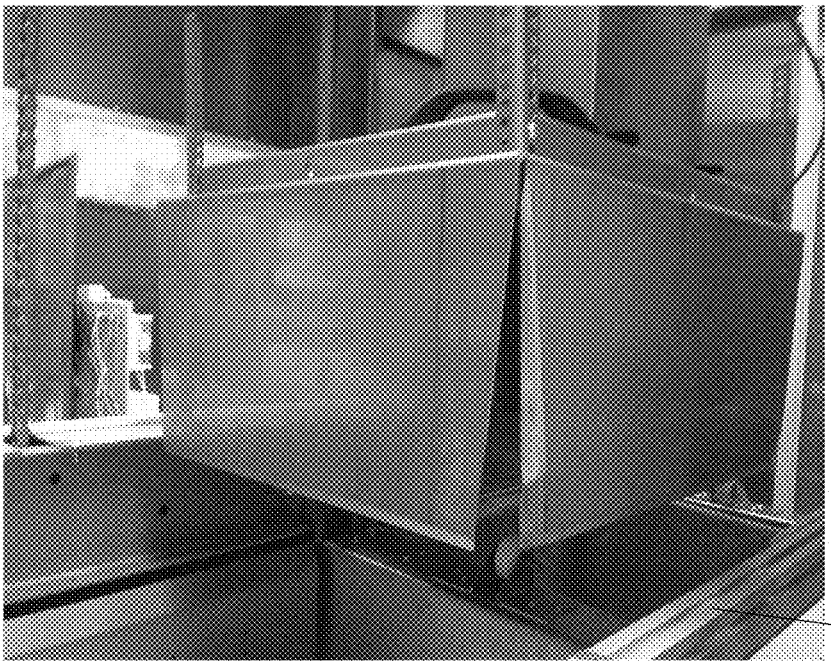
FIG. 11: shows a photograph of the transfer means in FIGS. 9 and 10 in an article delivery condition adjacent a carton.

As shown in FIG. 2 and FIG. 3, the carton packing apparatus includes a longitudinal frame housing 2 having a bottle in-feed conveyor 3 mounted at one end thereof and extending transverse to the longitudinal direction of the frame housing; a bottle accumulation platform 4 (best seen in FIGS. 7 and 8) being mounted within the longitudinal housing, oriented in the direction of the longitudinal frame housing 2, the accumulation platform having a front surface portion 100 adjacent the bottle receiving station of the bottle in-feed conveyor for receiving a predetermined number of bottles in a defined row or configuration; a carton in-feed conveyor 5 mounted to the housing extending parallel to and below the level of the bottle in-feed conveyor 3 including a carton receiving station 6; and a transfer means 7 which is movable by a drive assembly 225 located within the longitudinal housing above the accumulation platform.

As shown in FIG. 2 the carton in-feed conveyor 5 is mounted within and extends across the frame housing beneath the accumulation platform. As can be seen in a combination of FIGS. 3, 12 and 13, the carton in-feed conveyor defines a carton travel pathway 112 transverse to the longitudinal direction of the frame housing. The carton travel pathway 112 (indicated by arrows) includes a carton receiving station 6 located adjacent a second end of the accumulation platform for receiving a predetermined supply of articles. In one embodiment (not shown), the carton receiving station includes an elevator station 226 for lifting a carton thereon from the carton in-feed conveyor to a carton loading position, shown in FIG. 12.

Figure 13:
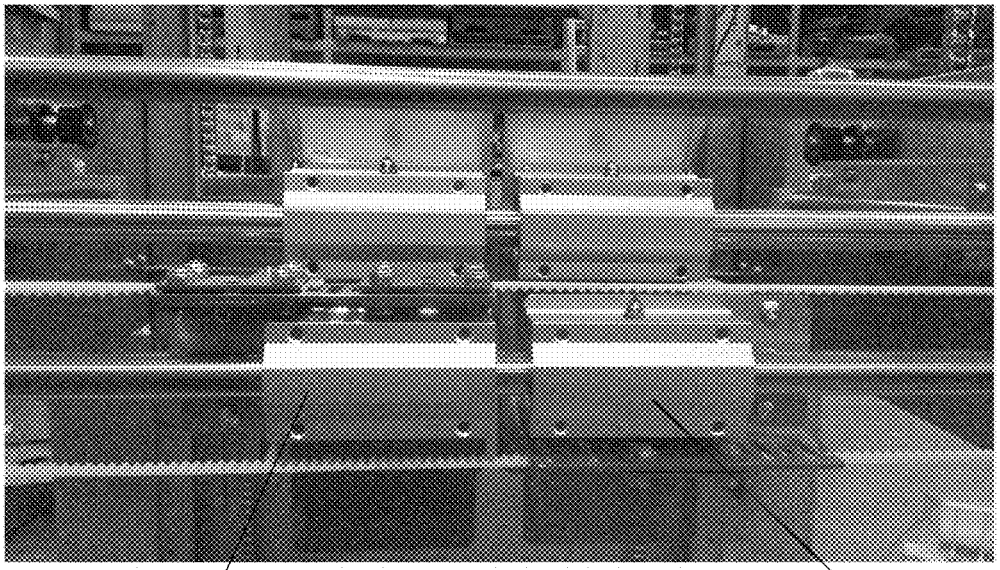
FIGS. 13, and 14: show a photograph of the carton receiving station of the carton packing apparatus according to one embodiment of the invention from front and side views respectively.
Figure 14:
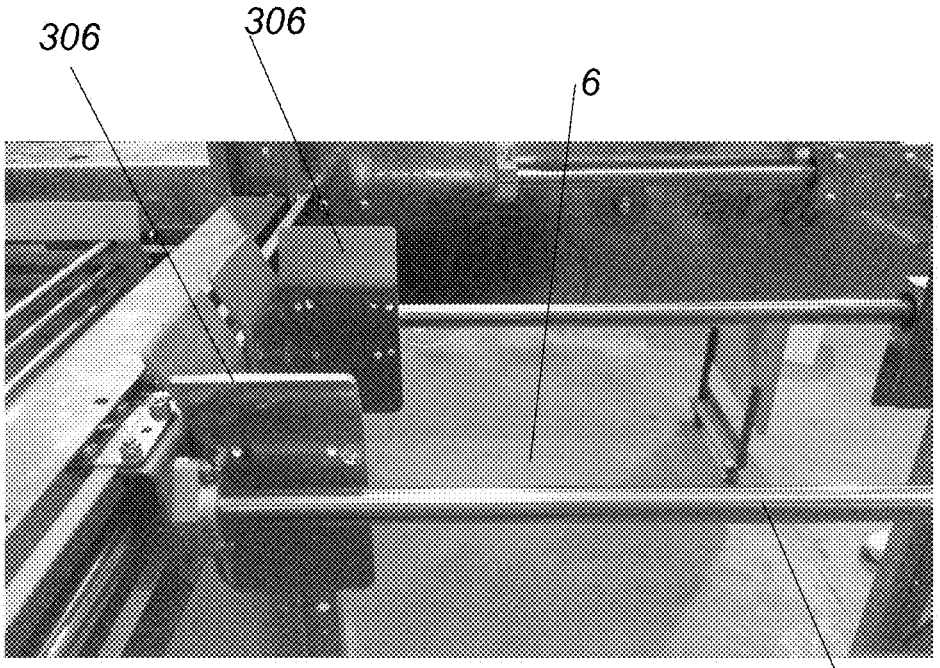
Figure 15:
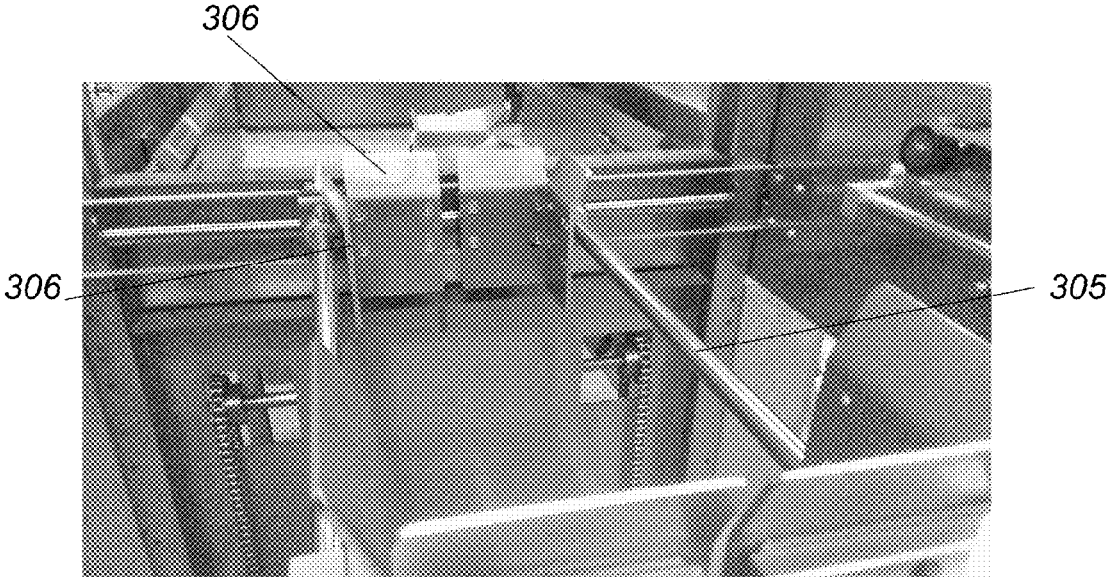
FIG. 15: shows a photograph of a front perspective view of the carton packing apparatus with carton receiving station in foreground, in accordance with one embodiment of the invention.

Referring to FIGS. 13 to 15, the carton receiving station 6 also includes a sub-assembly 305 and an array of hand members 306 movable on or over the sub-assembly, wherein the hand members are operably movable over defined pathways laterally and longitudinally according to dimensions of a carton at the receiving station (not shown) to secure an internal liner for the carton.

Figure 5:
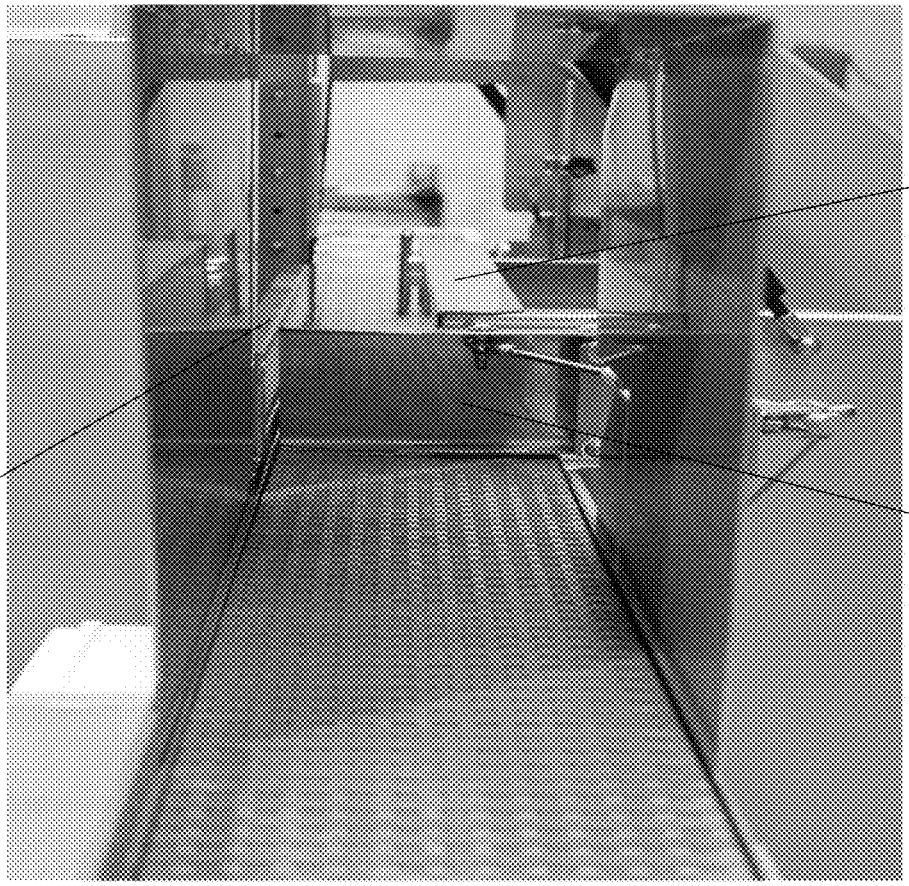
FIG. 5: shows a photograph of the container in-feed conveyor element from a side and opposing view to FIG. 4.
Figure 6:
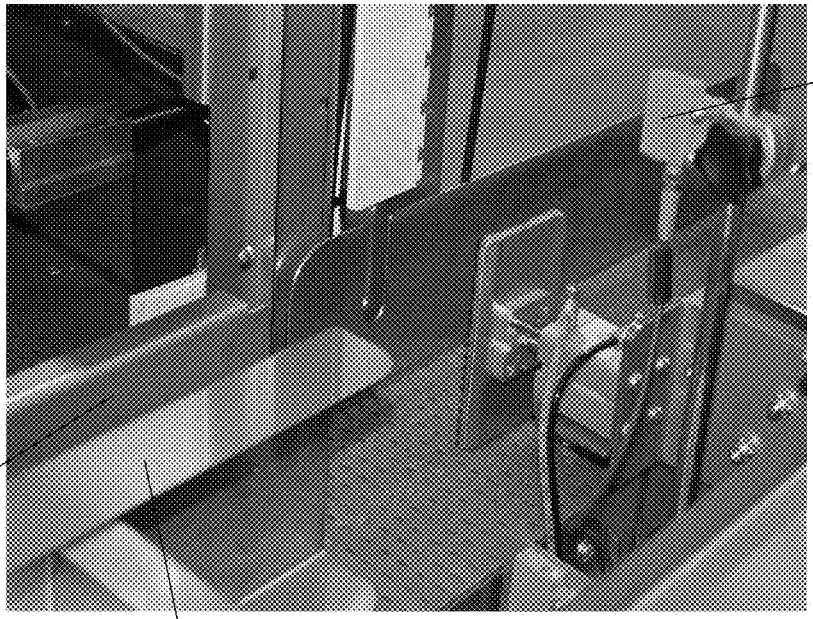
FIG. 6: shows a photograph of the container in-feed conveyor element of FIGS. 4 and 5 including a sensor element in accordance with one element of the present invention.

As best seen in FIGS. 5 and 6, the pushing means 103 is reciprocally located on the frame housing adjacent to the bottle in-feed receiving station. The operation of the pusher is linked to the in-feed sensor 108 so that when a predetermined number of bottles is sensed by sensor 108 at the in-feed station, the pusher pushes a row of bottles at the bottle in-feed station onto a front surface portion of the accumulation platform in a direction transverse to the in-feed conveyor. Once the pusher means has pushed a predetermined load of bottles at the receiving station onto a front surface portion of the accumulation platform, the pusher means returns to a non-pushing condition clearing the article receiving station for receipt of a subsequent load of articles from the in-feed conveyor.

The pusher 103 can be adjusted laterally relative to the article receiving station to allow formation of alternating offset rows of bottles onto the accumulation platform 4. The offset arrangement on the platform allow for efficient packing formation (not shown). The accumulation platform is adjustable in width by platform adjusters to accommodate a range of packing volumes.

In one embodiment (not shown), the pushing means further includes a shaped receiving portion which compliments the shape and configuration of an article. The article receiving portions of the pushing means can be complimentary to the shape of the article so as to accommodate different shaped articles stably for pushing onto the accumulation platform.

FIG. 2 also shows a gate 107 located adjacent the pushing means, the gate being reciprocally operable between a front portion of the accumulation platform and the article loading station, wherein the gate forms an angled wall with the pushing means to assist positioning and stabilizing of articles at the loading station, and wherein when a predetermined number of articles is located at the article loading station, the gate and pushing means sweep the predetermined number of articles onto a front portion of the accumulation platform in a cradled condition. In a further embodiment (not shown) the gate is attached to the pushing means 103 so that when the pushing means is moved laterally, the gate forms a stop for the next row of bottles.

The apparatus also includes a movable wall partition 110 intermediate the pusher means 103 and the accumulating platform 4. When a first row of bottles is received on the accumulation platform, the pusher returns to a non-pushing condition and the partition wall 301 returned to a closed position so that in combination the floor portion of the in-feed receiving station, the pusher 103, the wall partition 110 and the gate, form a passageway for stably receiving an in-feed of bottles from the in-feed conveyor.

The bottle in-feed conveyor 3, pusher 103, wall partition 110, gate and sensor therefore combine to form the in-feed receiving station, and the pusher, wall partition and gate form walls about the floor portion of the in-feed receiving station to form a movable passageway for stably receiving an in-feed of bottles in alternating row arrangement.

The transfer means 7 in one embodiment (best shown in FIGS. 8 to 11), includes a drive sub-assembly within the frame housing having a track 8 defining an internal pathway within the frame housing, a chain drive system 106, and a bottle pick up device 225, wherein the drive sub-assembly moves the bottle pick up device over the track between a bottle pick up position and a bottle delivery position close to the carton receiving or carton loading station. The chain drive system can be manually driven by external levers (not shown) or automatically operable by a central control (not shown) in communication with an array of sensors and a power source.

Figure 16:
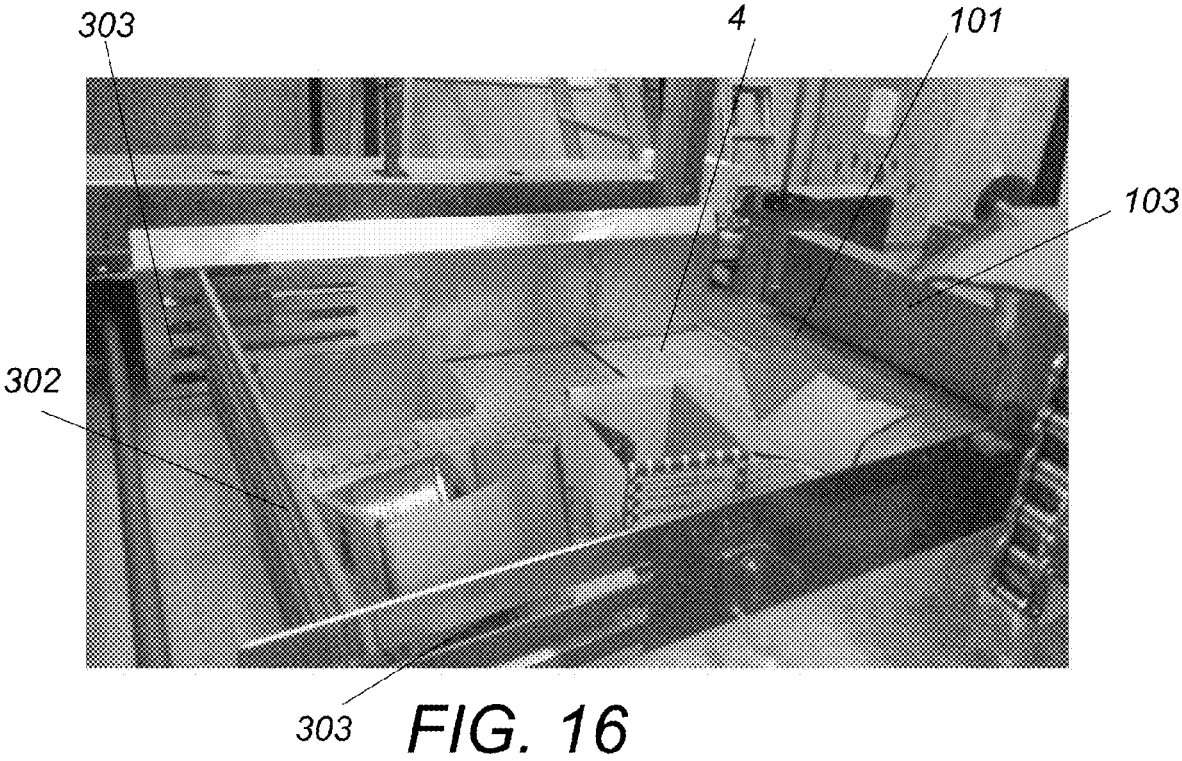
FIG. 16: shows a photograph of a part of the frame hosing with accumulation platform of the carton packing apparatus in accordance with a further embodiment of the invention.

The track 8 defines an internal pathway within the frame housing above the accumulation platform which allows movement of the transfer means by the transfer assembly between a bottle pick up position and a bottle delivery position adjacent the carton receiving station. The width of the accumulation platform can be varied by altering the position of wall member 228 by extending rods 229. Extending rods 229 can be manipulated manually by external knobs 230. Alternatively, as shown in FIG. 16, the platform 4 is surrounded by a three-sided framework perimeter which includes interengaging tongue 302 and groove 303 system for slidably adjusting the perimeter framework and thus the area of the platform 4 available for bottle accumulation.

The internal pathway includes a majority portion which is substantially collinear with the longitudinal direction X-X' of the housing 2. The carton packing apparatus 1 further includes an accumulation sensor 109 mounted to the frame housing so as to be located within the accumulation platform effective for detecting a predetermined number of bottles on the accumulation platform. In operation, when a predetermined number of bottles is loaded onto the accumulation platform, the accumulation sensor actuates the central control to power the transfer assembly. In this condition, the bottle pick up device 225 of the transfer means 7 is moved by the drive sub-assembly to a control pick-up position to pick up a predetermined load of bottles on the platform, and thereafter transfers the bottles to a carton waiting at the carton receiving or loading station.

FIG. 5 shows a bottle receiving station 101 including a combination of a floor portion of the in-feed conveyor, an end gate 107 operable to open and close, a pusher 103 and a wall partition 110 intermediate the pushing means 103 and front portion 100 of the platform 4. The in-feed bottle receiving station further includes an in-feed sensor 108 mounted to the frame housing upstream of the bottle in-feed station, as shown in FIG. 6.

The in-feed sensor 108 functions to determine bottle in-feed integrity, and is operatively linked to the gate 107. The sensor 108 is configured to sense height and time between bottles in an in-feed line approaching the in-feed receiving station on the in-feed conveyor. In one embodiment (not shown), if a bottle has fallen over on the in-feed conveyor, the sensor 108 will detect any time delay which would occur between a first sensed bottle an intermediate fallen bottle and a second sensed bottle. When the bottle in-feed sensor 108 detects a time delay, the end gate 107 is opened downstream from the bottle receiving station to allow a pass of bottles sufficient to allow a fallen bottle to exit the in-feed station. Once cleared, the operation continues. In essence, if a bottle is sensed as not being properly configured for transfer onto the accumulation platform, the end gate will open for egress of bottles until the sensor detects passage of a predetermined number of properly aligned bottles.

The bottle in-feed sensor can be configured for assessing article dimensions and time between adjacent articles on the in-feed conveyor moving past the sensor. If for example, a bottle has inadvertently fallen on the in-feed conveyor, the sensor determines that the time taken between passage of one sensed bottle and its nearest neighbor is greater than would be otherwise expected for predetermined input bottle dimensions. This determination causes the sensor to actuate opening of the end gate sufficient to allow the fallen bottle to exit the bottle in-feed receiving station.

As indicated, the bottle in-feed receiving station includes a wall partition 110 operably located between a front surface portion of the accumulation platform and the article receiving station. The wall partition forms a wall of the in-feed receiving station in a first condition to assist stabilize articles in the receiving station, and wherein when a predetermined number of articles is received at the article receiving station, the station gate is lowered beneath the accumulation platform within the frame housing to allow pushing of the predetermined number of articles by the pusher onto a front surface of the accumulation platform.

In a further embodiment, the transfer assembly includes an internal drive assembly mounted within the frame housing comprising a track system forming an internal pathway, and a chain drive system interconnected to the transfer means. In a transfer condition the chain drive engages the transfer means to move the transfer means over the track system between a pick-up position and a delivery/dispensing position. The drive assembly can also be operably connected to an actuator which actuates the drive system when the sensor detects a predetermined number of articles on the accumulating platform.

In one embodiment (not shown), the drive assembly can include a vibrating operating mode operable in a dispensing condition to apply a vibrating action to the transfer means at the point of dispensing the articles into a carton, wherein an array of articles is subject to a vibration action to assist arranging the articles in the carton.

In a further embodiment, the transfer means includes a sub-assembly mounted within the frame housing above the accumulation platform, the sub-assembly comprising a vacuum hood 111 (best seen in FIGS. 8 to 11), and chain drive system powered by an electric motor interconnected to the vacuum hood, such that the vacuum hood is movable by the chain drive over the article transfer pathway coaxial with the longitudinal direction of the frame housing.

The vacuum hood includes a vacuum chamber effective for receiving a predetermined number of articles therein under vacuum for transfer. The vacuum hood can include a vibration mechanism such that a load of articles such as bottles or the like can be stabilized once dispensed in the carton.

The sub-assembly further includes a complementary track formed in the housing and wheels mounted to the vacuum hood, wherein the wheels engage the track in an operating condition during transfer of a predetermined number of articles between the article accumulation platform and the carton loading station.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the carton packing industries.

The invention claimed is:

1. A carton packing apparatus occupying a small footprint for efficient packing of bulk quantities of plastic or glass bottles comprising:

a. a longitudinal frame housing having an accumulation platform mounted within and substantially in line with the longitudinal direction of the frame housing, wherein a continuous feed of bottles and cartons are fed transversely to a bottle receiving station and a carton receiving station, respectively, adjacent opposite ends of the accumulation platform, and wherein the bottle receiving station is located immediately adjacent a front edge portion of the accumulation platform;

b. a bottle transfer means movably mounted within the frame housing, the bottle transfer means being movable over an internal pathway substantially in line with the accumulation platform; and c. a pushing means located adjacent to the bottle receiving station opposite the accumulation platform, wherein when a predetermined number of bottles is presented at the bottle receiving station, the pushing means operably and reciprocally locates the predetermined number of bottles onto the front edge portion of the accumulation platform forming a first row of bottles thereon, wherein subsequent rows of bottles are presented to the front edge portion of the accumulation platform in turn displacing the first row or previous rows of bottles in a repeated cycle until a predetermined number of rows of bottles is accumulated on the accumulation platform;

d. a movable wall partition intermediate the pushing means and the front edge portion of the accumulation platform, wherein the movable wall partition and the pushing means form opposite facing walls at the bottle receiving station;

e. a gate located adjacent the pushing means and configured to form an angled wall with the pushing means and the movable wall partition;

wherein the movable wall partition, the pushing means and the gate form surrounding walls that substantially stabilize bottles received at the bottle receiving station;

wherein in an operating condition the bottle transfer means transfers a predetermined number of rows of bottles accumulated on the accumulation platform to the carton receiving station over the internal pathway for packing in the carton in a single pass.

2. The carton packing apparatus according to claim 1 further comprising:

a bottle in-feed conveyor mounted to the frame housing extending transverse to the accumulation platform, the bottle in-feed conveyor comprising the bottle receiving station adjacent a first end of the accumulation platform, wherein the bottle receiving station is adapted to receive a predetermined number of bottles thereon for transfer to the front edge of the accumulation platform; and a carton in-feed conveyor mounted within and extending across the frame housing beneath the accumulation platform, the carton in-feed conveyor defining a carton travel pathway transverse to the longitudinal direction of the frame housing and located forward of the bottle in-feed conveyor, wherein the carton in-feed conveyor comprises the carton receiving station adjacent a second end of the accumulation platform for receiving a predetermined supply of bottles.

3. The carton packing apparatus according to claim 1 further comprising a drive assembly for driving movement of the bottle transfer means over the internal pathway, wherein the drive assembly is actuated by a sensor means in communication with the drive assembly, wherein the sensor means is located in the frame housing relative to the accumulation platform and configured to actuate the drive assembly when a predetermined number of bottles is detected on the accumulation platform.

4. The carton packing apparatus according to claim 3 wherein the drive assembly includes a track system mounted within the frame housing forming the internal pathway, and a chain drive assembly interconnected to the bottle transfer means, wherein in a transfer condition the chain drive engages with the bottle transfer means to move the bottle transfer means over the track system between a pick-up position and a dispensing position.

5. The carton packing apparatus according to claim 4 wherein the drive assembly is operably connected to an actuator which actuates the chain drive assembly when the sensor means detects a predetermined number of bottles on the accumulating platform.

6. The carton packing apparatus according to claim 1, wherein when a predetermined number of bottles is received at the bottle receiving station, the movable wall partition is displaced within the frame housing to allow transfer of the bottles by the pushing means onto a front edge of the accumulation platform.

7. The carton packing apparatus according to claim 1, wherein the bottle transfer means is operable by a drive assembly mounted within the frame housing, wherein the bottle transfer means is movable by the drive assembly over an internal pathway within the frame housing above the accumulation platform between a bottle pick up and dispensing condition.

8. The carton packing apparatus according to claim 1 wherein the gate is reciprocally operable between the front edge portion of the accumulation platform and the bottle receiving station, and wherein when a predetermined number of bottles is located at the bottle receiving station, the gate and pushing means sweep the predetermined number of bottles onto the front edge portion of the accumulation platform in a cradled condition.

9. A carton packing apparatus for efficient packing of bulk quantities of plastic or glass bottles into a carton, the apparatus comprising:

a. a longitudinal frame housing;

b. an accumulation platform mounted within the frame housing for receiving a predetermined number of bottles thereon;

c. a bottle in-feed conveyor mounted to the frame housing extending transverse to the accumulation platform, the bottle in-feed conveyor including a bottle receiving station adjacent a first end of the accumulation platform, wherein the bottle receiving station is adapted to receive a predetermined number of bottles thereon for transfer to the accumulation platform;

d. a carton in-feed conveyor mounted within and extending across the frame housing beneath the accumulation platform, the carton in-feed conveyor defining a carton travel pathway transverse to the longitudinal direction of the frame housing and located forward of the bottle in-feed conveyor, wherein the carton in-feed conveyor comprises a carton loading station adjacent a second end of the accumulation platform for receiving a predetermined supply of bottles, and an elevator station at a carton receiving station including a lifting means adapted to raise a carton from the carton receiving station to the carton loading station;

e. a bottle transfer means movably mounted within the frame housing for transporting bottles from the accumulation platform to the carton loading station, the bottle transfer means being movable over a transfer pathway within the housing between a bottle pick-up position and a carton delivery position, wherein the transfer pathway is substantially coaxial with the longitudinal direction of the frame housing;

f. a pushing means reciprocally located adjacent the bottle receiving station for urging a predetermined number of bottles at the bottle receiving station onto a front surface portion of the accumulation platform in a direction transverse to the bottle in-feed conveyor, wherein the pushing means is adjusted laterally relative to the bottle receiving station to urge alternating rows of predetermined bottles supplied at the bottle receiving station onto the front surface portion of the accumulation platform in alternating rows, wherein rows of bottles are automatically arranged on the accumulation platform in an offset formation to allow for offset packing formation of the bottles;

g. a bottle in-feed sensor located adjacent the bottle in-feed conveyor upstream of the bottle receiving station for determining bottle in-feed integrity, and a gate downstream from the bottle receiving station adjacent the pushing means, wherein the bottle in-feed sensor is operatively linked to the gate so that if a bottle is sensed as not being properly configured for transfer onto the accumulation platform, the gate will open for egress of bottles until the sensor detects passage of a predetermined number of properly aligned bottles;

h. a movable wall partition intermediate the pushing means and the front surface portion of the accumulation platform, wherein the movable wall partition and the pushing means form opposite facing walls at the bottle receiving station and wherein the gate forms an angled wall with the pushing means and the movable wall partition and wherein the movable wall partition, the pushing means and the gate form surrounding walls that substantially stabilize bottles received at the bottle receiving station, and wherein when a predetermined number of bottles is located at the bottle receiving station, the gate and pushing means sweep the predetermined number of bottles onto a front portion of the accumulation platform in a cradled condition;

i. wherein when a predetermined number of bottles is supplied to the accumulation platform, the bottle transfer means is operable to transfer the predetermined number of bottles from a bottle pick-up position on the accumulation platform to the carton loading station for loading the carton in a single pass.

10. The carton packing apparatus according to claim 9 wherein the bottle transfer means includes a drive assembly mounted within the frame structure above the accumulation platform, the drive assembly comprising a vacuum hood and a chain drive system powered by an electric motor interconnected to the vacuum hood, such that the vacuum hood is movable by the chain drive over the transfer pathway coaxial with the longitudinal direction of the frame housing.

11. The carton packing apparatus according to claim 10 wherein the vacuum hood includes a vacuum chamber effective for receiving a predetermined number of bottles therein under vacuum for transfer.

12. The carton packing apparatus according to claim 10 wherein the vacuum hood includes a vibration mechanism such that a load of bottles can be stabilized once dispensed in the carton.

13. The carton packing apparatus according to claim 9 wherein the bottle transfer means includes a sub-assembly mounted within the frame housing above the accumulation platform, the sub-assembly comprising a vacuum hood and a chain drive system powered by an electric motor interconnected to the vacuum hood, such that the vacuum hood is movable by the chain drive over the bottle transfer pathway coaxial with the longitudinal direction of the frame housing.

14. The carton packing apparatus according to claim 13 wherein the sub-assembly further includes a complementary track formed in the housing and wheels mounted to the vacuum hood, wherein the wheels engage the track in an operating condition during transfer of a predetermined number of bottles between the accumulation platform and the carton loading station.

15. The carton packing apparatus according to claim 9 wherein the bottle in-feed sensor is configured for assessing bottle dimensions and time between adjacent bottles on the bottle in-feed conveyor moving past the sensor.

16. The carton packing apparatus according to claim 15 wherein the sensor determines that the time taken between passage of one sensed bottle and its nearest neighbor is greater than would be otherwise expected for predetermined input bottle dimensions and the determination causes the sensor to actuate opening of the gate sufficient to allow the fallen bottle to exit the bottle receiving station.

17. The carton packing apparatus according to claim 9 wherein the accumulation platform includes a platform sensor for determining a predetermined number of bottles on the accumulation platform.

18. The carton packing apparatus according to claim 17 wherein once a predetermined number of bottles on the platform is detected, the platform sensor operably actuates the bottle transfer means.

19. The carton packing apparatus according to claim 9 wherein the accumulation platform is adjustable in width by platform adjusters to accommodate a range of packing volumes.

* * * * *